US008708465B1

(12) United States Patent
Cellura et al.

(10) Patent No.: US 8,708,465 B1
(45) Date of Patent: Apr. 29, 2014

(54) METHOD FOR PROTECTING PIEZOELECTRIC TRANSDUCER

(71) Applicant: Xerox Corporation, Norwalk, CT (US)

(72) Inventors: Mark A. Cellura, Webster, NY (US); Peter J. Nystrom, Webster, NY (US); Bryan R. Dolan, Webster, NY (US); Gary D. Redding, Victor, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/743,311

(22) Filed: Jan. 16, 2013

(51) Int. Cl.
*B41J 2/045* (2006.01)

(52) U.S. Cl.
USPC ..... 347/70

(58) Field of Classification Search
None
See application file for complete search history.

(56) References Cited

U.S. PATENT DOCUMENTS 8,348,396 B2 * 1/2013 Pollard ..... 347/72

* cited by examiner

*Primary Examiner* — Lisa M Solomon
(74) *Attorney, Agent, or Firm* — Fay Sharpe LLP

(57) ABSTRACT

Disclosed is a process for preparing an ink jet printhead which comprises: (a) providing a diaphragm plate having a plurality of piezoelectric transducers bonded thereto with an adhesive; (b) placing an encapsulant thin film on the piezoelectric transducers; and (c) applying heat, pressure, or a combination thereof to the encapsulant thin film to a degree sufficient to cause the encapsulant to encapsulate the adhesive.

12 Claims, 6 Drawing Sheets

METHOD FOR PROTECTING PIEZOELECTRIC TRANSDUCER

BACKGROUND

Disclosed herein are piezoelectric ink jet printheads and methods for making them.

Ink jet systems include one or more printheads having a plurality of jets from which drops of fluid are ejected towards a recording medium. The jets of a printhead receive ink from an ink supply chamber or manifold in the printhead which, in turn, receives ink from a source, such as an ink reservoir or an ink cartridge. Each jet includes a channel having one end in fluid communication with the ink supply manifold. The other end of the ink channel has an orifice or nozzle for ejecting drops of ink. The nozzles of the jets can be formed in an aperture or nozzle plate having openings corresponding to the nozzles of the jets. During operation, drop ejecting signals activate actuators in the jets to expel drops of fluid from the jet nozzles onto the recording medium. By selectively activating the actuators of the jets to eject drops as the recording medium and/or printhead assembly are moved relative to one another, the deposited drops can be precisely patterned to form particular text and graphic images on the recording medium.

Piezoelectric ink jet printheads typically include a flexible diaphragm and a piezoelectric transducer attached to the diaphragm. When a voltage is applied to the piezoelectric transducer, typically through electrical connection with an electrode electrically coupled to a voltage source, the piezoelectric transducer deflects or bends, causing the diaphragm to flex which expels a quantity of ink from a chamber through a nozzle. The flexing further draws ink into the chamber from a main ink reservoir through an opening to replace the expelled ink.

Piezoelectric transducers are bonded to the diaphragm with an adhesive. If exposed to oxygen, this adhesive can degrade over time and compromise the bond integrity between the piezoelectric transducer and the diaphragm, thus impeding or preventing drop ejection. Adhesives that are both robust to oxidation and suitable for this application are difficult to obtain.

Other proposed solutions have additional difficulties. For example, filling the piezoelectric transducer area with a liquid adhesive or epoxy and subsequently curing it would require multiple steps and additional time, and would also require mixing and dispensing the liquid adhesive or epoxy, which frequently introduces air bubbles into the adhesive that would need to be removed before curing. Another possible solution, creating a perimeter seal around the entire piezoelectric transducer area, would require additional capital machinery in the form of dispense robots and expertise.

SUMMARY

Disclosed herein is a process for preparing an ink jet printhead which comprises: (a) providing a diaphragm plate having a plurality of piezoelectric transducers bonded thereto with an adhesive; (b) placing an encapsulant thin film on the piezoelectric transducers; and (c) applying heat, pressure, or a combination thereof to the encapsulant thin film to a degree sufficient to cause the encapsulant to encapsulate the adhesive. Also disclosed herein is a process for preparing an ink jet printhead which comprises: (a) providing a diaphragm plate having a plurality of piezoelectric transducers each having a plurality of surfaces, said piezoelectric transducers being bonded to the diaphragm plate on at least one surface with an adhesive, said piezoelectric transducers having at least one surface unbonded to the diaphragm plate, the unbonded surfaces of multiple piezoelectric transducers defining interstices therebetween; (b) placing an encapsulant thin film on at least one surface of the piezoelectric transducers not bonded to the diaphragm plate; and (c) applying heat, pressure, or a combination thereof to the encapsulant thin film to a degree sufficient to cause the encapsulant to flow into the interstices and encapsulate the adhesive. Further disclosed herein is an ink jet printhead comprising: (a) a diaphragm plate; (b) a plurality of piezoelectric transducers mounted on the diaphragm plate with an adhesive; (c) an encapsulant material encapsulating the adhesive; (d) a plurality of nozzles corresponding to the piezoelectric transducers and operatively connected thereto; and (e) an electrical circuit board operatively connected to the piezoelectric transducers.

Figure 1:
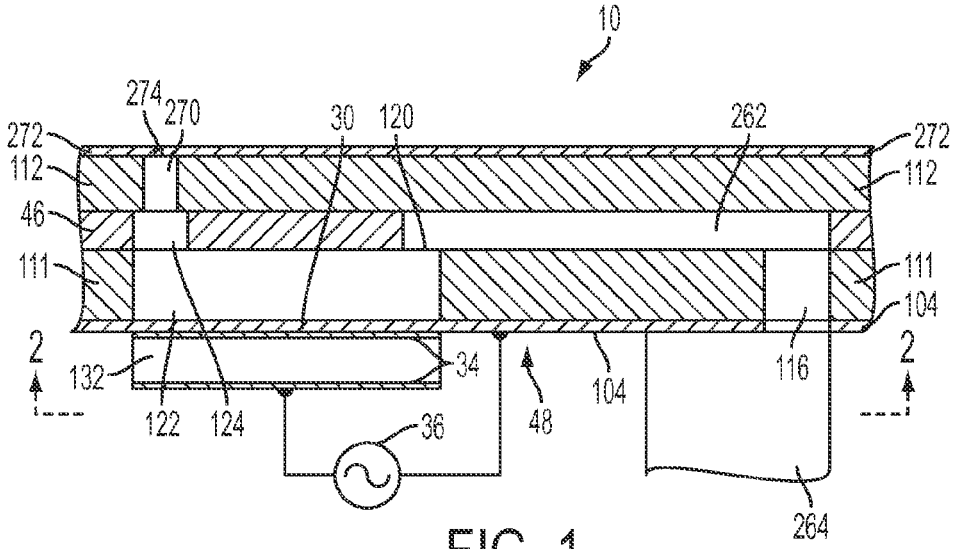
FIG. 1 is a schematic cross sectional side view of an embodiment of an ink jet printhead.

Drawings are not to scale.

DETAILED DESCRIPTION

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, multi-function machine, or the like. Devices of this type can also be used in bioassays, masking for lithography, printing electronic components such as printed organic electronics, and making 3D models among other applications. The word "polymer" encompasses any one of a broad range of carbon-based compounds formed from long-chain molecules, including thermoset polyimides, thermoplastics, resins, polycarbonates, epoxies, or related compounds known to the art, as well as mixtures thereof. The word "ink" can refer to wax-based inks or gel-based inks known in the art and can also refer to any fluid that can be driven from the jets, including water-based solutions, solvents and solvent-based solutions, or UV-curable polymers, as well as mixtures thereof. The word "metal" encompasses single metallic elements, including those such as copper, aluminum, titanium, or the like, or metallic alloys, including those such as stainless steel alloys, aluminum-manganese alloys, or the like, as well as mixtures thereof. A "transducer" as used herein is a component that reacts to an electrical signal by generating a moving force that acts on an adjacent surface or substance. The moving force may push against or retract the adjacent surface or substance.

Figure 2:
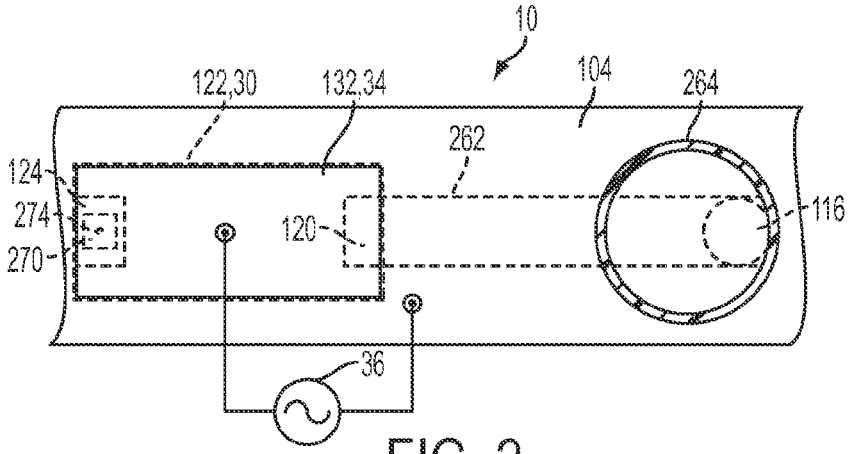
FIG. 2 is a schematic view of the embodiment of the ink jet printhead of FIG. 1.

FIGS. 1 and 2 illustrate one example of a single ink jet ejector 10 suitable for use in an ink jet array of a printhead. The ink jet ejector 10 has a body 48 coupled to an ink manifold 264 through which ink is delivered to multiple ink jet bodies. The body also includes an ink drop-forming orifice or nozzle 274 through which ink is ejected. In general, the ink jet printhead includes an array of closely spaced ink jet ejectors 10 that eject drops of ink onto an image receiving member (not shown), such as a sheet of paper or an intermediate imaging member.

Ink flows from the manifold to nozzle in a continuous path. Ink leaves the manifold 264 and travels through a port 116, an inlet 262, and a pressure chamber opening 120 into the ink pressure chamber 122. Ink pressure chamber 122 is bounded on one side by a flexible diaphragm 30. A piezoelectric transducer 132 is rigidly secured to diaphragm 30 by any suitable technique and overlays ink pressure chamber 122. Metal film layers 34 that can be coupled to an electronic transducer driver 36 in an electronic circuit can also be positioned on both sides of the piezoelectric transducer 132.

Ejection of an ink droplet is commenced with a firing signal. The firing signal is applied across metal film layers 34 to excite the piezoelectric transducer 132, which causes the transducer to bend. Upon actuation of the piezoelectric transducer, the diaphragm 30 deforms to force ink from the ink pressure chamber 122 through the outlet port 124, outlet channel 270, and nozzle 274. The expelled ink forms a drop of ink that lands onto an image receiving member. Refill of ink pressure chamber 122 following the ejection of an ink drop is augmented by reverse bending of piezoelectric transducer 132 and the concomitant movement of diaphragm 30 that draws ink from manifold 264 into pressure chamber 122.

To facilitate manufacture of an ink jet array printhead, an array of ink jet ejectors 10 can be formed from multiple laminated plates or sheets. These sheets are configured with a plurality of pressure chambers, outlets, and apertures and then stacked in a superimposed relationship. The embodiments shown in the Figures are illustrative, and sometimes more or fewer layers are employed to accomplish fluidic routing in a similar manner.

Referring once again to FIGS. 1 and 2 for construction of a single ink jet ejector, these sheets or plates include a diaphragm plate or layer 104, an ink jet body plate 111, an inlet plate 46, an outlet plate 112, and an aperture plate 272. The piezoelectric transducer 132 is bonded to diaphragm 30, which is a region of the diaphragm plate 104 that overlies ink pressure chamber 122.

Figure 3:
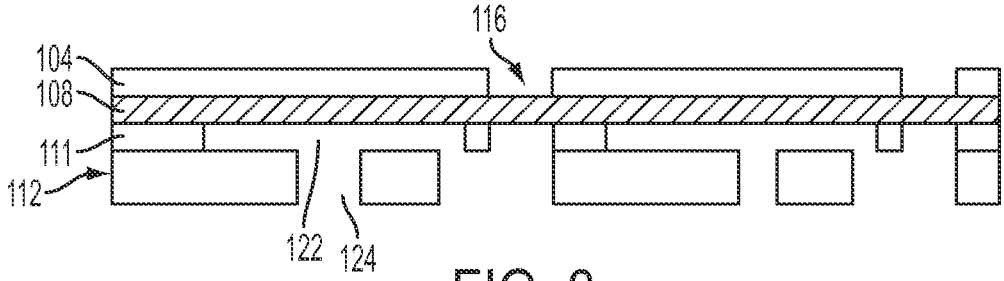
FIG. 3 is a profile view of a partially completed ink jet printhead, including a diaphragm layer, body layer, and a polymer layer.

FIG. 3 is a profile view of a partially completed ink jet printhead including a diaphragm plate or layer 104, body layer 111, and a thermoplastic polymer layer 108. The diaphragm plate 104 may be formed from a metal, ceramic, glass, or plastic sheet that has one or more ink ports 116 that extend through the layer, with one ink port corresponding to each pressure chamber 122 in the body layer 111. The diaphragm plate should be thin enough to be able to flex easily, but also resilient enough to return to its original shape after it has been deformed. The diaphragm layer is bonded to a polymer layer, which is bonded as an unbroken sheet. DuPont ELJ-100® is an example of a material that is suitable to form the polymer layer. The polymer layer may also be formed from a polyimide material or other polymers including polyetherether ketone, polysulfone, polyester, polyethersulfone, polyimideamide, polyamide, polyethylenenaphthalene, etc. The polymer layer can be a self-adhesive thermoplastic or have a thin layer of adhesive deposited on the side of the polymer layer that is placed in contact with the body layer 111. Alternatively, another thermoplastic or thermoset adhesive could be used to bond the polymer layer to the diaphragm. In yet further alternatives the adhesive could be a dispensed or transfer film of liquid adhesive.

The body layer is bonded to the opposite side of the polymer layer. The fluid path layer may be formed from one or multiple metal sheets that are joined via brazing as shown here as the body plate 111 and the outlet plate 112. The fluid path layer can also be made from a single structure molded, etched, or otherwise produced. The fluid path layer contains openings or channels through the various layers that form paths and cavities for the flow of ink through the finished printhead. A pressure chamber is structured with diaphragm layer 104 and polymer layer 108 forming the top portion, the body plate 111 and the outlet plate 112 forming the fluid body layer and providing the lateral walls and base for the pressure chamber. The chamber base has an outlet port 124 that allows ink held in the pressure chamber to exit the body layer when the diaphragm is deformed by a piezoelectric transducer (not shown).

Figure 4:
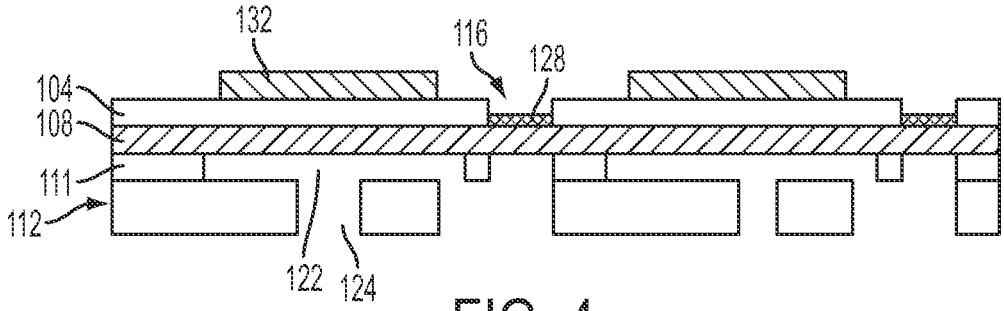
FIG. 4 is a profile view of the same partial ink jet printhead of FIG. 3 additionally including piezoelectric transducers bonded to the diaphragm layer.

FIG. 4 is a profile view of the same partial ink jet printhead of FIG. 3 additionally including bonded piezoelectric transducers. In this view, a piezoelectric transducer 132 has been bonded to the diaphragm plate 104 in alignment with the pressure chamber 122. In order to bond the piezoelectric transducers to the appropriate locations, they are first arranged on a carrier plate (not shown in FIG. 4) with the sides opposite the diaphragm plate temporarily affixed to the carrier plate. Then, an adhesive such as a thermoset polymer, typically an epoxy, is deposited on the surface of the diaphragm sheet. The carrier plate is aligned with the diaphragm plate, and pressure and heat are applied until the thermoset polymer has bonded the piezoelectric transducers to the diaphragm plate. The carrier plate is then released using known techniques from the piezoelectric transducers. The pressure from the bonding process squeezes excess adhesive thermoset polymer 128 from under the piezoelectric elements, leaving residual adhesive on the exposed diaphragm, some of which may flow into the ink ports 116. Flow of the bonding adhesive is stopped at the polymer bonding layer 108. The piezoelectric transducers are now rigidly bonded to the diaphragm plate so that when one of the piezoelectric transducers deforms, the diaphragm plate deforms in the same direction.

The piezoelectric transducers have a plurality of surfaces, at least one of which is bonded to the diaphragm plate. Four surfaces (i.e., a tetrahedron) is the least number of surfaces a three-dimensional object can have. Typically, the piezoelectric transducers will have six surfaces, although other configurations and configurations with more surfaces are also possible. In a specific embodiment, the piezoelectric transducers are cube-shaped or tile-shaped (i.e., have six surfaces, or approximately so if the edges of the cubes or tiles are not perfectly sharp) and one surface thereof is bonded to the diaphragm plate with the adhesive.

Figure 5:
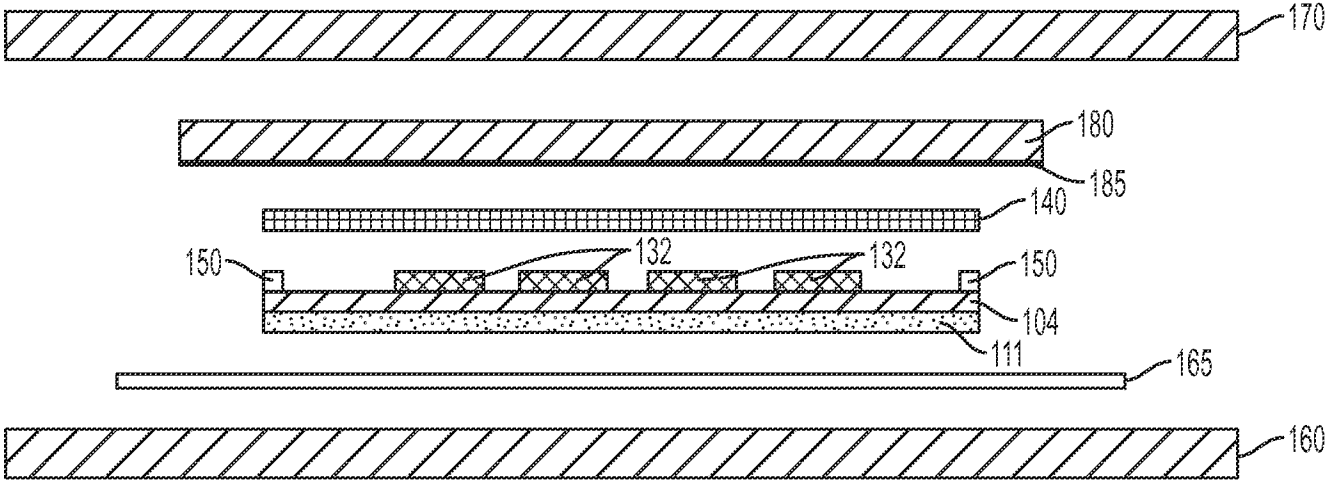
FIG. 5 is a schematic exploded profile view of a partial ink jet printhead in a stack press during the manufacturing process.

FIG. 5 is a schematic exploded profile view of a partial ink jet printhead in a stack press during the manufacturing process. Piezoelectric transducers 132 have been bonded to diaphragm plate 104, which in turn is situated on body plate 111, by the method shown in FIG. 4. Encapsulant thin film 140 is situated on top of piezoelectric transducers 132. Spacers 150 are situated on diaphragm plate 104, and are of approximately the same height as piezoelectric transducers 132 so that encapsulant thin film 140 lies in an approximate plane across the array. The arrangement is situated in a stack press, having stack press lower cassette 160 and stack press upper platen 170. A sacrificial layer of protective material 165, such as TEFLON® or the like, is situated between stack press lower cassette 160 and the printhead. Disposable block 180, part of the stack press, is situated between stack press upper platen 170 and encapsulant thin film 140. Disposable block 180 is coated with mold release agent 185 or other suitable means for preventing adhesion thereto.

Encapsulant thin film 140 is formulated of a thin film encapsulant material, such as an oligomer, a polymer, or other suitable material. Examples of suitable encapsulant materials include polyamideimide resins, such as HITACHI KS6600, a siloxane modified polyamideimide resin available from Hitachi Chemical Co., Japan, or the like.

By "thin film" is meant a thin, continuous material in the form of a sheet or membrane. It can be oligomeric or polymeric or of another suitable material.

The thin film can be of any desired or effective thickness. In one embodiment, the thin film is roughly approximate in thickness to the thickness of the piezoelectric transducers. For example, if the piezoelectric transducers are 50 μm thick, the thin film is in one embodiment at least about 38 μm, in another embodiment at least about 43 μm, and in yet another embodiment at least about 48 μm, and in one embodiment no more than about 62 μm, in another embodiment no more than about 57 μm, and in yet another embodiment no more than about 52 μm.

The encapsulant material has a Young's modulus sufficiently low to minimize mechanical coupling or crosstalk between adjacent piezoelectric transducers, in one embodiment 2 gigaPascals or less, and in another embodiment 1 gigaPascal or less.

In one embodiment the encapsulant material is a thermoset material, curable at temperatures of in one embodiment at least about 25° C., in another embodiment at least about 50° C., and in yet another embodiment at least about 100° C., and in one embodiment no more than about 500° C., in another embodiment no more than about 400° C., and in yet another embodiment no more than about 300° C.

In another embodiment, the encapsulant material can be a thermoplastic material, particularly when the operating temperature of the printhead is below the melting point of the thermoplastic material. In this embodiment, the thermoplastic material can be subjected to temperatures similar to those suitable for curing the thermoset material.

The encapsulant material can be a gel, crystalline, semicrystalline, or amorphous, and mixtures of suitable materials can also be used; accordingly, suitable melting points, softening points, and glass transition points for specific embodiments will be provided.

The encapsulant material can have a melting point of in one embodiment at least about 25° C., in another embodiment at least about 50° C., and in yet another embodiment at least about 100° C., and in one embodiment no more than about 500° C., in another embodiment no more than about 400° C., and in yet another embodiment no more than about 300° C.

The encapsulant material can have a reflow point of in one embodiment at least about 25° C., in another embodiment at least about 50° C., and in yet another embodiment at least about 100° C., and in one embodiment no more than about 500° C., in another embodiment no more than about 400° C., and in yet another embodiment no more than about 300° C.

The encapsulant material can have a softening point of in one embodiment at least about 25° C., in another embodiment at least about 50° C., and in yet another embodiment at least about 100° C., and in one embodiment no more than about 500° C., in another embodiment no more than about 400° C., and in yet another embodiment no more than about 300° C.

The encapsulant material can have a glass transition temperature ($T_g$) of in one embodiment at least about 25° C., in another embodiment at least about 50° C., and in yet another embodiment at least about 100° C., and in one embodiment no more than about 500° C., in another embodiment no more than about 400° C., and in yet another embodiment no more than about 300° C.

The stack press is operated at a temperature and pressure and for a period of time sufficient to effect desirable flow characteristics of the encapsulant material. The temperature and pressure will depend on the specific material used as the encapsulant, and are generally provided with the encapsulant manufacturer's instructions. The temperature is generally above the Tg in the case of an amorphous material, and is below the melting point of a thermoplastic material. An example of suitable time, temperature, and pressure conditions for HITACHI KS6600 are 200 pounds per square inch (PSI) at 290° C. for 30 minutes.

Subsequently, the encapsulant can be cured. For example, the encapsulant can be cured at in one embodiment at least about 50 psi, in another embodiment at least about 150 psi, and in yet another embodiment at least about 180 psi, and in one embodiment no more than about 300 psi, in another embodiment no more than about 250 psi, and in yet another embodiment no more than about 220 psi.

The encapsulant can be cured at, for example, in one embodiment at least about 50° C., in another embodiment at least about 150° C., and in yet another embodiment at least about 180° C., and in one embodiment no more than about 350° C., in another embodiment no more than about 250° C., and in yet another embodiment no more than about 220° C.

The encapsulant can be cured for, for example, in one embodiment at least about 10 minutes, in another embodiment at least about 20 minutes, and in yet another embodiment at least about 30 minutes, and in one embodiment no more than about 200 minutes, in another embodiment no more than about 100 minutes, and in yet another embodiment no more than about 50 minutes.

For purposes of subsequent manufacturing steps, it is sometimes desirable that the encapsulant material fill the interstices between the piezoelectric transducers to a substantial extent, leaving relatively shallow valleys or no valleys between the transducers. The adhesive used to apply subsequent layers, such as the circuit (a flexible circuit in some embodiments) can then further fill these shallow remaining valleys without impairing the planar structure of the printhead. In these embodiments, the maximum remaining depth of the interstitial area between piezoelectric transducers after being filled with the encapsulant material is in one embodiment 25 μm or less, in another embodiment 15 μm or less, and in yet another embodiment 10 μm or less.

Figure 6:
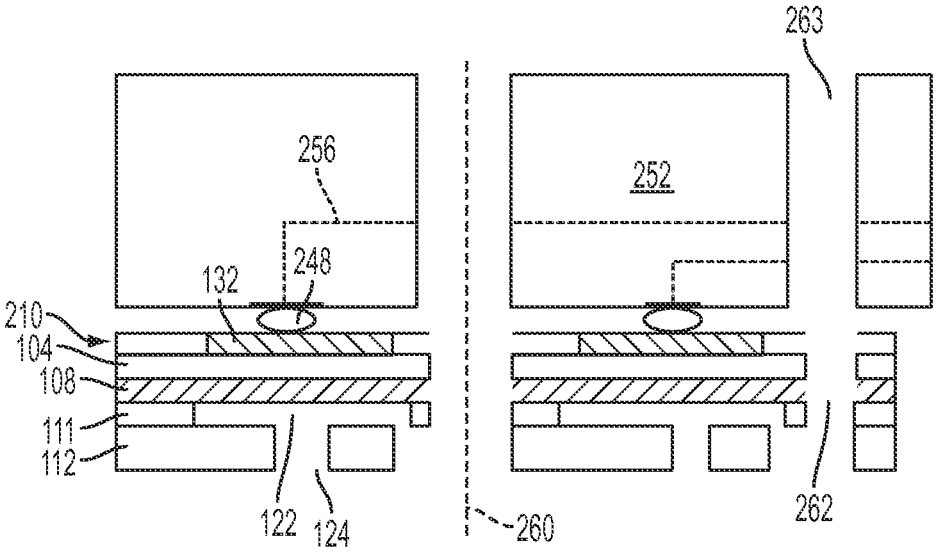
FIG. 6 is a profile view of the completed assembly prepared as described in FIG. 5 after the assembly is bonded to an electrical circuit board and ink channels have been ablated.

FIG. 6 is a profile view of the completed assembly prepared as described in FIG. 5 after the ink jet ejector is bonded to an electrical circuit board (ECB) 252 and the ink inlets have been ablated. In one embodiment, a laser is used to drill the ink passages 262 through the polymer layer 108.

Pre-existing holes 263 in the ECB 252 are larger than the ink passages 262 and aligned with the ink passages so that the ink path is not interrupted by the circuit board 252. In another embodiment, the circuit board can be replaced by a flexible circuit having electrical pads aligned to the array of piezoelectric elements similar to the ECB. For the flexible circuit pre-existing holes for ink passages can exist, or in one embodiment, the ink passages are formed in the laser drilling process that forms the ink passage 262. As further described below, the full printhead assembly and order of layer processing can happen in many different orders so long as the polymer layer 108 is attached to the diaphragm 104 prior to the piezoelectric elements 132 being added to the assembly.

Figure 7:
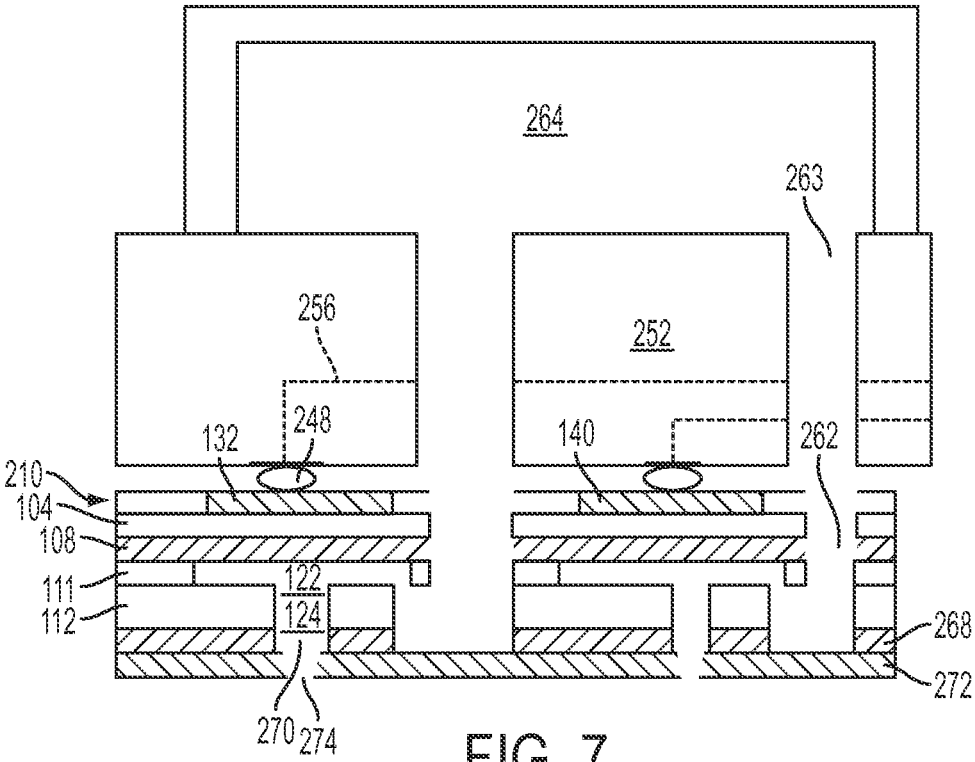
FIG. 7 is a profile view of a complete ink jet head including an outlet plate attached to the body layer and an ink manifold attached to a rigid or flexible electrical circuit layer.

FIG. 7 is a profile view of a complete ink jet head including an aperture plate 272 attached to the outlet plate 112 by aperture plate adhesive 268. The manifold 264 acts as an ink reservoir supplying ink to the inlets of one or more pressure chambers, and each pressure chamber has a dedicated ink inlet connected to the manifold. The body layer 111 is attached to an outlet layer 212 to form a portion of each pressure chamber. The aperture plate adhesive 268 includes an outlet channel 270 corresponding to each pressure chamber. The aperture plate 272 may be formed from metal or a polymer and has apertures or nozzles 274 extending through the plate to allow ink to exit the printhead as droplets.

Other embodiments may have different numbers of layers or combine several functions into a single layer. Other assembly and processing orders are also possible.

In operation, ink flows from the manifold through ECB channel 263 and the inlet port 262 into the pressure chamber 122. An electrical firing signal sent to the piezoelectric transducer 132 in piezoelectric layer 210 via conductive traces 256 and conducting epoxy 248 or other means of producing the electrical connection 248 causes the piezoelectric transducer to bend, deforming the diaphragm 104 and polymer layer 108 into the pressure chamber. This deformation urges ink out the outlet port 124, into the outlet channel 270, and through the nozzle 274 where the ink exits the printhead as a droplet. After the ink droplet is ejected, the chamber is refilled with ink supplied from the manifold with the piezoelectric transducer aiding the process by deforming in the opposite direction to cause the concomitant movement of the diaphragm and polymer layers that draw ink from the manifold into the pressure chamber.

Figure 9:
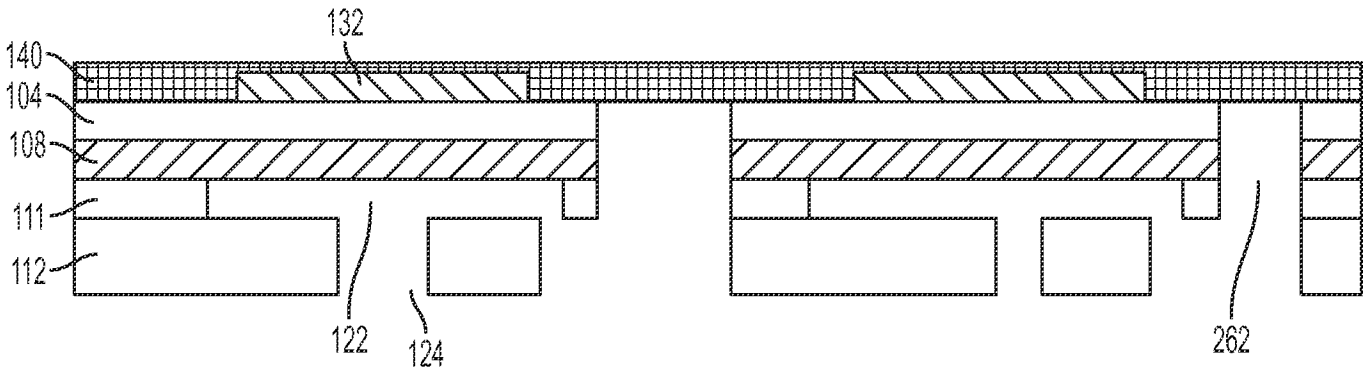
FIG. 9 is a profile view of the same partial ink jet printhead of FIG. 4 additionally including encapsulant material pressed into the interstitial areas between the piezoelectric transducers.

FIG. 9 is a view similar to that of FIG. 4 showing the same partial ink jet printhead after the encapsulant material 140 has been pressed into the interstitial areas between piezoelectric transducers 132. Note that a small amount of encapsulant material 140 is present on top of piezoelectric transducers 132.

Specific embodiments will now be described in detail. These examples are intended to be illustrative, and the claims are not limited to the materials, conditions, or process parameters set forth in these embodiments. All parts and percentages are by weight unless otherwise indicated.

Example I

A partial printhead array was provided comprising a body plate of 316L stainless steel, a diaphragm layer of 316L stainless steel, and piezoelectric transducers in 20×84 array bonded to the diaphragm layer with lead zirconate titanate.

The partial printhead array was placed in a stack press in the configuration illustrated in FIG. 5 and a thin film of HITACHI KS6600 38 μm thick was laid on top of the piezoelectric transducers. Heat and pressure were applied at 200 PSI at 290° C. for 30 min according to the manufacturer's recommended bonding parameters for high flow. No bubbles or voids were observed. The surface topography was not characterized. The tops of all of the piezoelectric transducer tiles were covered by the encapsulant material.

Example II

The process of Example I was repeated except that ADWILL D-624 ultraviolet release tape 90 μm thick, obtained from Lintec of America, was used instead of the HITACHI KS6600 as the encapsulant. Heat and pressure were applied at 100 PSI at 190° C. for 30 min. The material exhibited high flow characteristics and no bubbles or voids were observed. The surface topography was not characterized. The tops of all of the piezoelectric transducer tiles were covered by the encapsulant material.

Example III

Figure 8:
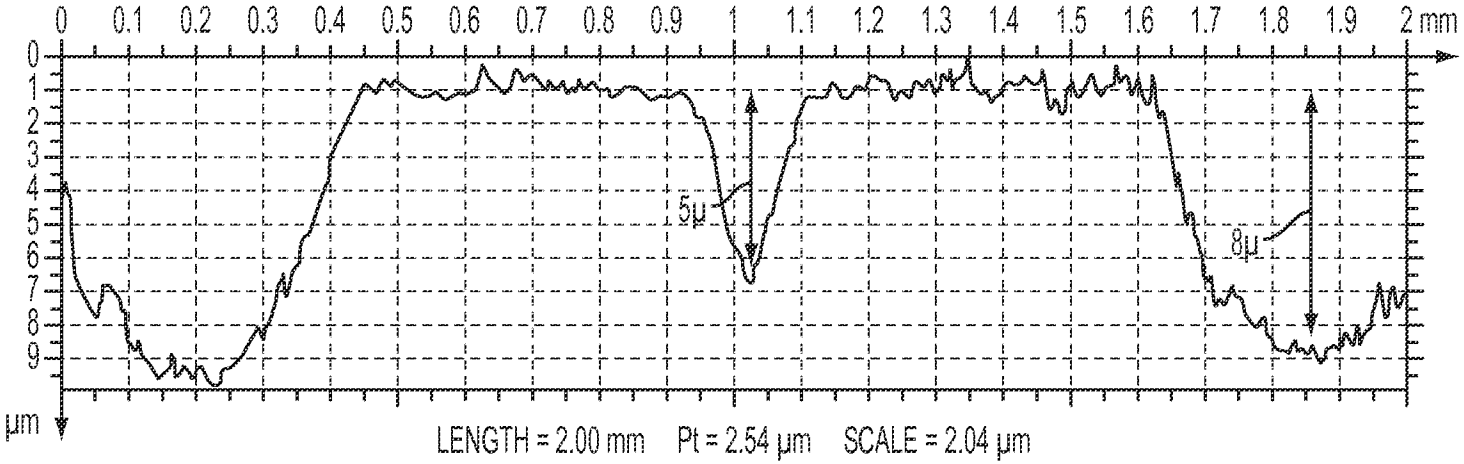
FIG. 8 is a graph of surface depth across the width of the printhead prepared in Example III.

The process of Example I was repeated except that ADWILL G-65 release tape 90 μm thick, obtained from Lintec of America, was used instead of the HITACHI KS6600 as the encapsulant. Heat and pressure were applied at 100 PSI at 190° C. for 30 min. The material exhibited high flow characteristics and no bubbles or voids were observed. The surface topography was characterized, and is illustrated in FIG. 8. FIG. 8 is a graph of surface depth (y-axis) across the width of the printhead subsequent to application of the encapsulant. As FIG. 8 indicates, dips of only 5 μm were observed in the narrow interstices, and dips of 8 μm were observed in the wide interstices. Since wide interstices are not present in commercially fabricated printheads, it is believed that dips of 5 μm will be the maximum observed in commercially fabricated printheads. The tops of all of the piezoelectric transducer tiles were covered by the encapsulant material.

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefor, is not intended to limit a claimed process to any order except as specified in the claim itself.

What is claimed is:

1. A process for preparing an ink jet printhead which comprises:

(a) providing a diaphragm plate having a plurality of piezoelectric transducers bonded thereto with an adhesive;

(b) placing an encapsulant thin film on the piezoelectric transducers; and (c) applying heat, pressure, or a combination thereof to the encapsulant thin film to a degree sufficient to cause the encapsulant to encapsulate the adhesive.

2. A process according to claim 1 wherein the adhesive is subject to oxidation.

3. A process according to claim 1 wherein the adhesive is an epoxy.

4. A process according to claim 1 wherein the encapsulant is a polyamideimide.

5. A process according to claim 1 wherein the encapsulant is a siloxane-modified polyamideimide.

6. A process according to claim 1 wherein the encapsulant has a Young's modulus has a Young's modulus of 2 gigaPascals or less.

7. A process according to claim 1 wherein the encapsulant is a thermoset material.

8. A process according to claim 1 wherein the encapsulant is a thermoplastic material.

9. A process according to claim 1 wherein the encapsulant has a melting point of at least about 25° C., and wherein the encapsulant has a melting point of no more than about 500° C.

10. A process according to claim 1 wherein the encapsulant has a reflow point of at least about 25° C., and wherein the encapsulant has a reflow point of no more than about 500° C.

11. A process according to claim 1 wherein the encapsulant has a softening point of at least about 25° C., and wherein the encapsulant has a softening point of no more than about 500° C.

12. A process according to claim 1 wherein the encapsulant has a $T_g$ of at least about 25° C., and wherein the encapsulant has a $T_g$ of no more than about 500° C.

* * * * *